US007980237B1

(12) United States Patent
Rasor et al.

(10) Patent No.: US 7,980,237 B1
(45) Date of Patent: Jul. 19, 2011

(54) INTEGRATED FALL AWAY ARROW REST

(75) Inventors: Allen C. Rasor, Marana, AZ (US); David H. Kronengold, Tucson, AZ (US); Benjamin Blosser, Richland, IN (US)

(73) Assignee: Precision Shooting Equipment, Tucson, AZ (US)

( * ) Notice: Subject to any disclaimer, the term of this patent is extended or adjusted under 35 U.S.C. 154(b) by 491 days.

(21) Appl. No.: 12/108,163

(22) Filed: Apr. 23, 2008

(51) Int. Cl.
*F41B 5/22* (2006.01)

(52) U.S. Cl. ..... 124/44.5

(58) Field of Classification Search ..... 124/24.1, 124/44.5

See application file for complete search history.

(56) References Cited

U.S. PATENT DOCUMENTS

| | | | | |
|---|---|---|---|---|
| 2,975,780 | A | | 3/1961 | Fisher |
| 3,504,659 | A | | 4/1970 | Babington |
| 4,071,014 | A | | 1/1978 | Trotter |
| 4,287,868 | A | | 9/1981 | Schiff |
| 4,344,409 | A | | 8/1982 | Barner |
| 4,453,528 | A | | 6/1984 | Eckert |
| 4,907,566 | A | * | 3/1990 | Klein ..... 124/44.5 |
| 5,062,407 | A | | 11/1991 | Newbold |
| 5,103,797 | A | | 4/1992 | Newbold |
| 5,137,006 | A | | 8/1992 | Gallops |
| 5,150,700 | A | * | 9/1992 | Troncoso ..... 124/44.5 |
| 5,372,119 | A | | 12/1994 | Kidney |
| 5,394,858 | A | | 3/1995 | Karolian |
| 5,415,154 | A | | 5/1995 | Angeloni |
| 5,421,314 | A | | 6/1995 | Kidney |
| 5,490,491 | A | | 2/1996 | Troncoso |
| 5,490,492 | A | | 2/1996 | Savage |
| 5,632,263 | A | | 5/1997 | Sartain |
| 5,685,287 | A | | 11/1997 | Greywall |
| 5,944,005 | A | | 8/1999 | Schiff |
| 6,044,832 | A | | 4/2000 | Piersons, Jr. |
| 6,615,813 | B1 | | 9/2003 | Troncoso, Jr. |
| 6,742,510 | B2 | | 6/2004 | Troncoso, Jr. |
| 6,782,881 | B2 | | 8/2004 | Mizek et al. |
| 6,789,536 | B1 | | 9/2004 | Summers |
| 6,814,068 | B1 | | 11/2004 | Troncoso, Jr. |
| 6,823,856 | B2 | * | 11/2004 | Rager ..... 124/44.5 |

* cited by examiner

*Primary Examiner* — John Ricci
(74) *Attorney, Agent, or Firm* — Cahill Glazer PLC

(57) ABSTRACT

A pivoting arrow rest is positioned in a support position for contacting and supporting an arrow shaft in a "ready" position and is rotated by a biasing spring into a recess provided in a riser shelf in response to a triggering event. The biasing spring is contained within the riser.

9 Claims, 5 Drawing Sheets

INTEGRATED FALL AWAY ARROW REST

FIELD OF THE INVENTION

The invention relates to compound archery bows, and more particularly to arrow rests forming a part of the compound bow riser.

BACKGROUND OF THE INVENTION

A variety of arrow rests have been utilized in the prior art for use in combination with compound archery bows to support arrow shafts before, during and after the release of the arrow from the bow. The prior art has also suggested a variety of forms of arrow rests mounted on the archery bow in various positions and with various accessory attachments. The prior art has also suggested the use of a pivoting arrow rest that changes position upon the release of the arrow to prevent interference with the arrow as it passes the riser of the bow.

However, a variety of accessories and attachments that are taught by the prior art to accomplish the releasable support of an arrow shaft interfere with one of the primary purposes for such powerful compound bows, that is, hunting. Strenuous bow hunting frequently results in contact between the bow and dense undergrowth and frequent impacts with objects such as rocks, trees and the like. During this time that the bow is being carried, critical and sometimes delicate accessories are damaged and rendered unusable. Arrow rests, particularly those that are movable in response to the motion of an arrow shaft are particularly susceptible to damage during rough hunting conditions.

OBJECTS OF THE INVENTION

It is therefore an object of the present invention to provide a compound archery bow having an arrow rest that is virtually immune to rough hunting conditions.

It is another object of the present invention to provide a compound bow having a retractable or pivoting arrow rest that retracts within the riser.

It is another object of the present invention to provide a compound archery bow having a retractable or pivoting arrow rest that is biased to a retracted position within the riser.

It is still another object of the present invention to provide a compound archery bow having a pivoting arrow rest that is biased to a retracted position by a spring biasing means contained within the riser.

BRIEF DESCRIPTION OF THE DRAWINGS

The present invention may more readily be described by reference to the accompanying drawings in which.

DETAILED DESCRIPTION OF THE INVENTION

Figure 1:
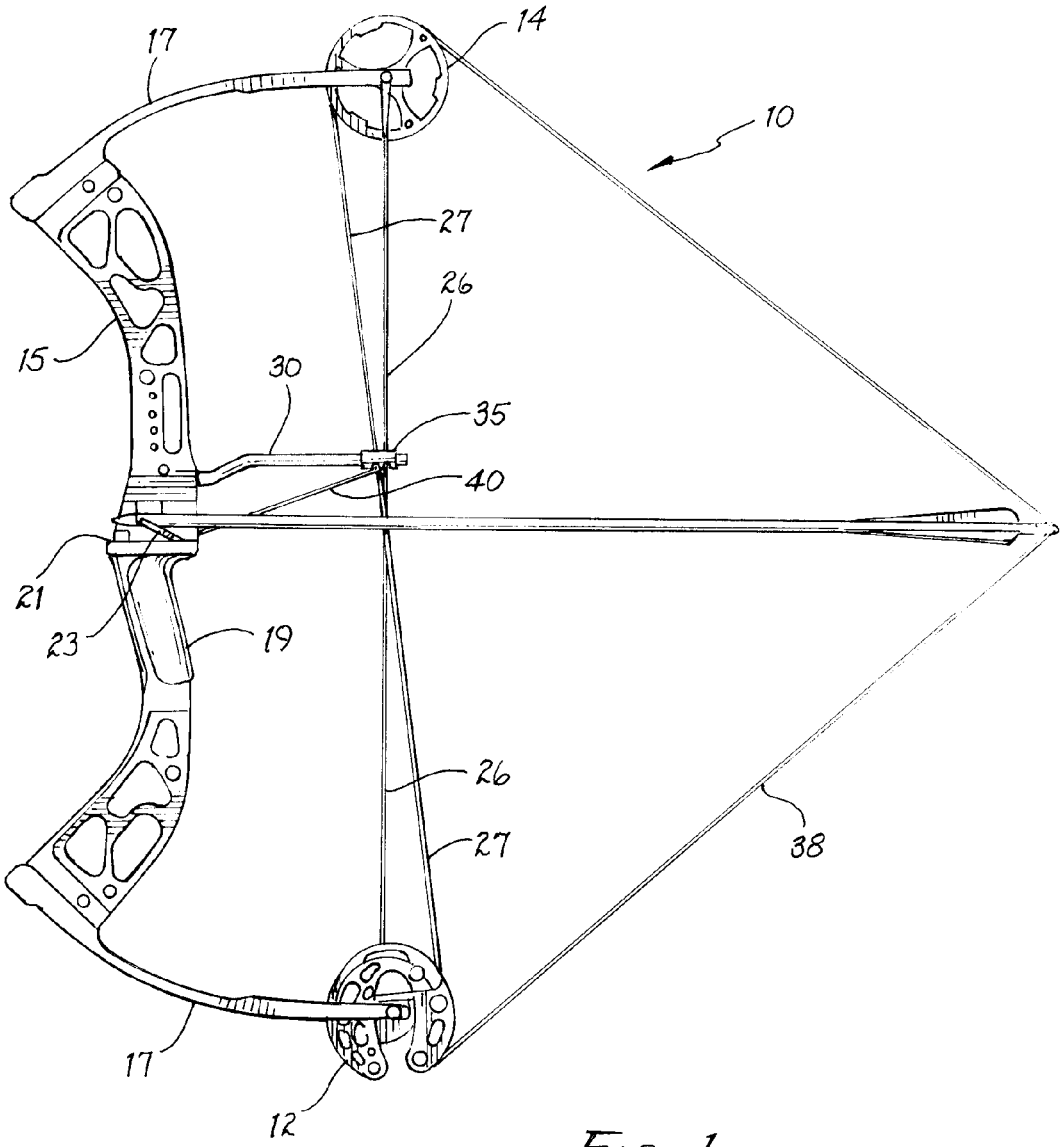
FIG. 1 is a schematic representation of a compound bow showing the bow in a drawn position with an arrow rest supporting the arrow shaft.

Referring to FIG. 1, a typical compound bow 10 is shown; the bow chosen for illustration is a single cam bow utilizing a cam 12 and a wheel 14. The present invention is equally applicable to dual cam bows. A riser 15 supports limbs 17 rotatably supporting cam 12 and wheel 14 thereon. The riser 15 includes grip 19 and a shelf recess 21 from which an arrow rest 23 extends to support an arrow 24. The bow system includes cables 26 and 27 secured in a well known manner to provide bending forces to the respective limbs. A cable slide 35 extends from the riser to maintain the cable positions outside of the plane formed by the bowstring 38 and the arrow 24 to prevent interference with the arrow as it is propelled by the bow system. The cables 26 and 27 are typically guided past the cable guide 30 through the utilization of a cable slide 35 that maintains the position of the cables out of the above described plane while maintaining separation of the respective cables. The cable slide will normally slide axially on the cable guide during the operation of the bow during draw and subsequent release. A trigger cord 40, to be described more fully hereinafter, is secured to the cable slide.

Figure 2:
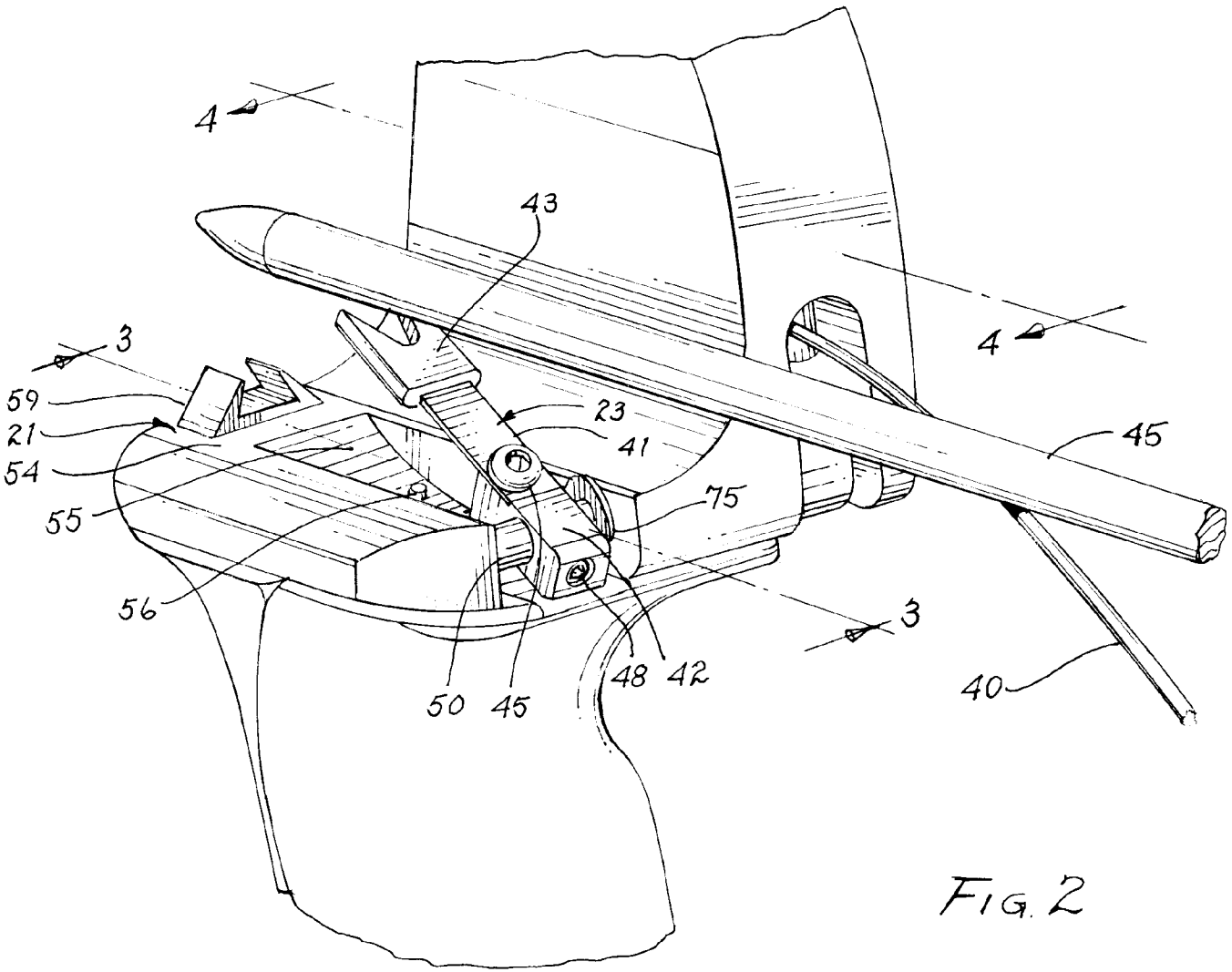
FIG. 2 is an enlarged perspective view of a portion of the compound bow of FIG. 1 showing details of the arrow rest system of the present invention.

Referring to FIG. 2, the arrow rest 23 is shown and includes a bifurcated arrow rest tip 43 mounted on an arrow rest arm 41 which in turn is secured to an arrow rest support block 42. An attachment screw 45 secures the arrow rest support block 42 to the arrow rest arm. This attachment screw permits the removal for replacement or repair of the arrow rest arm or the replacement of the arm with an arm of different length to thereby adjust the height that the arrow rest 23 may provide. The arrow rest arm 41 may also include a longitudinal slot (not shown) to permit sliding adjustment between the arrow rest arm and the support block 42 by simply loosening the attachment screw 45, making the appropriate adjustment, and tightening the attachment screw.

The arrow rest support block 42 is secured to an actuating shaft 50 by a support block set screw 48. The actuating shaft 50 rotates about its axis and imparts rotational movement of the arrow rest 23 about that axis. The set screw 48 can be used to adjust the arrow rest height above the shelf in addition to any adjustment that may be acquired by adjusting the length of the arrow rest arm 41. In FIG. 2 the arrow rest is shown in its supporting position; the rest is pivoted about the activating shaft 50 and swings downwardly into a shelf recess 55 formed as an integral part of the shelf recess 21 and riser 15. A supplemental arrow rest 59 may be provided for supporting an arrow shaft when the bow is in a rest condition.

Figure 3:
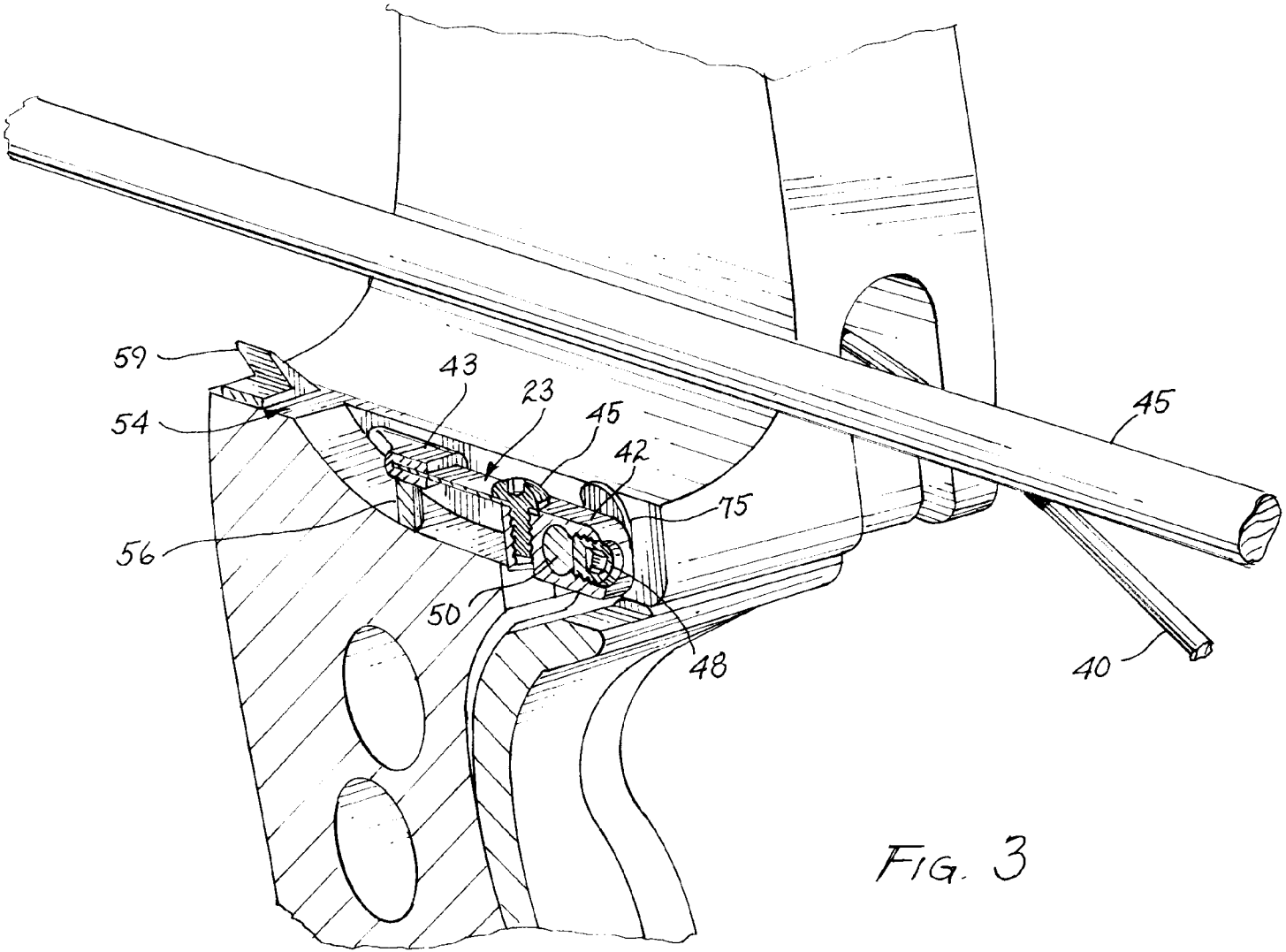
FIG. 3 is a partially cross-sectioned view of a compound bow riser incorporating the teachings of the present invention.

Referring to FIG. 3, the view represented by FIG. 2 has been partially cross-sectioned to show the arrow rest and supporting structures in greater detail. Further, the arrow rest in FIG. 3 is shown in its non-supporting or rest position wherein the arrow rest 23 is pivoted about the actuating shaft 50 into the shelf recess 55. It may be seen that the arrow rest has been positioned completely within the shelf recess and is below or substantially even with the upper surface 54 of the shelf. In this retracted position, the arrow rest has been effectively withdrawn and is completely immune to inadvertent impact, snagging, or damaging blows that frequently occur during strenuous hunting activities. The arrow rest forms an important feature of the compound bow and is a critical element of the bow system during the mounting of an arrow, drawing and discharging the bow system.

Figure 4B:
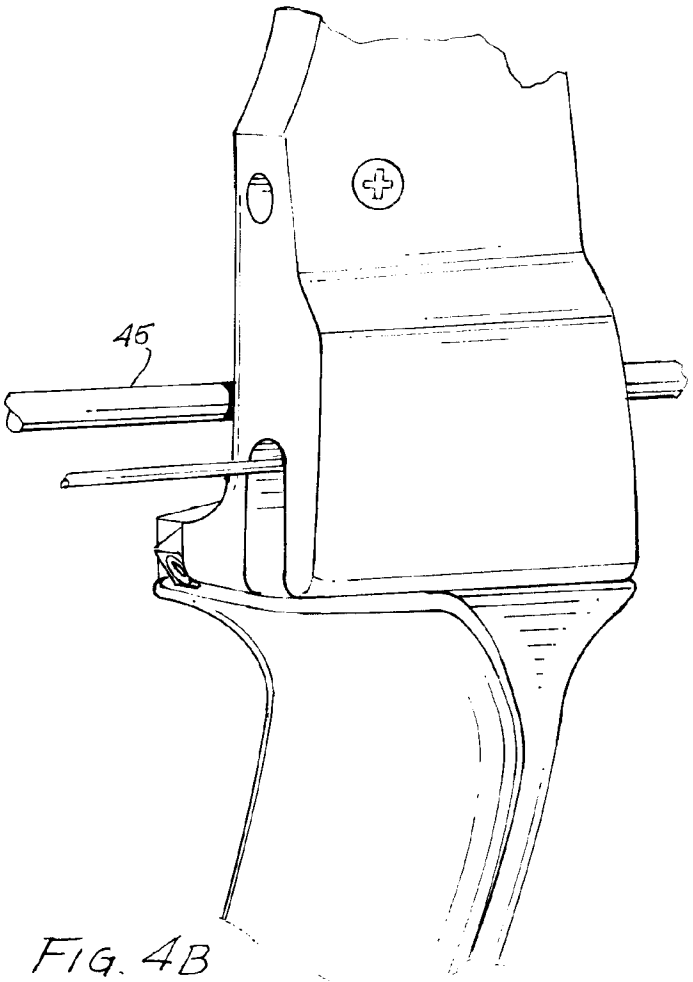
FIG. 4*b* is an abbreviated illustration of the reverse side of the riser shown in FIG. 4*a*.
Figure 4A:
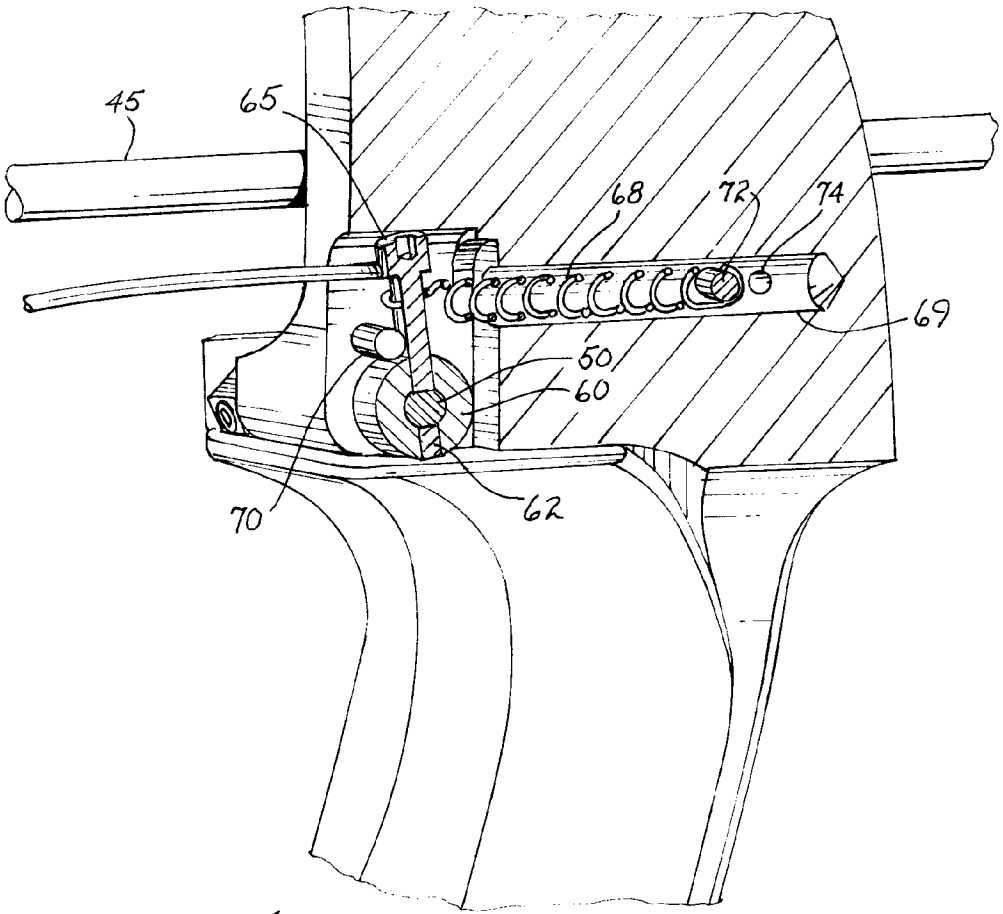
FIG. 4*a* is a partially sectioned view of a portion of a compound bow riser incorporating the teachings of the present invention and showing a side of the riser opposite to that of FIG. 3.

Referring now to FIG. 4*a*, the opposite side of the compound bow, as shown in FIG. 2, is shown partly in section. The riser is shown sectioned to reveal the actuating shaft 50 and actuating collar 60. The collar 60 is fixed for rotation with the actuating shaft 50 by an actuating collar set screw 62. The set screw can be loosened and the actuating collar rotated with respect to the actuating shaft 50 to adjust tension in a biasing means to be described.

An actuating pin 65 is threadedly engaged to the actuating collar 60, thus the actuating collar, actuating shaft 50, and actuating pin 65 rotate in unison about a longitudinal axis of the actuating shaft 50. A biasing means such as a coil tension spring 68 is coupled to the actuating pin and extends into a biasing means recess 69 machined into the riser. The opposite end of the tension spring 68 is connected to anchor pin 72. Anchor pin 72 may conveniently be formed of a set screw threadedly engaging a hole provided therefor and extending to the outside surface of the riser. An alternate positioning hole 74 is provided to reposition the anchor pin 72 to accommodate a longer tension spring. It may be noted that the biasing means recess 69 is completely contained within the riser. In the embodiment chosen for illustration, the biasing means recess is formed by drilling a cylindrical passageway to accept a tension spring and is a blind hole.

FIG. 4*b* is an illustration of the reverse side of the riser portion shown in FIG. 4*a*. It may be noted that this side of the riser is free from any protrusions, extensions or any mechanisms relating to the arrow rest, the arrow rest mechanism, the biasing means or tension spring, or any other element relating to the positioning of or operation of the arrow rest. There are no accessory fittings relating to the arrow rest and the riser is devoid of any protrusions or extensions that may otherwise become entangled with or strike foreign objects that would affect the operation of the arrow rest.

Figure 5:
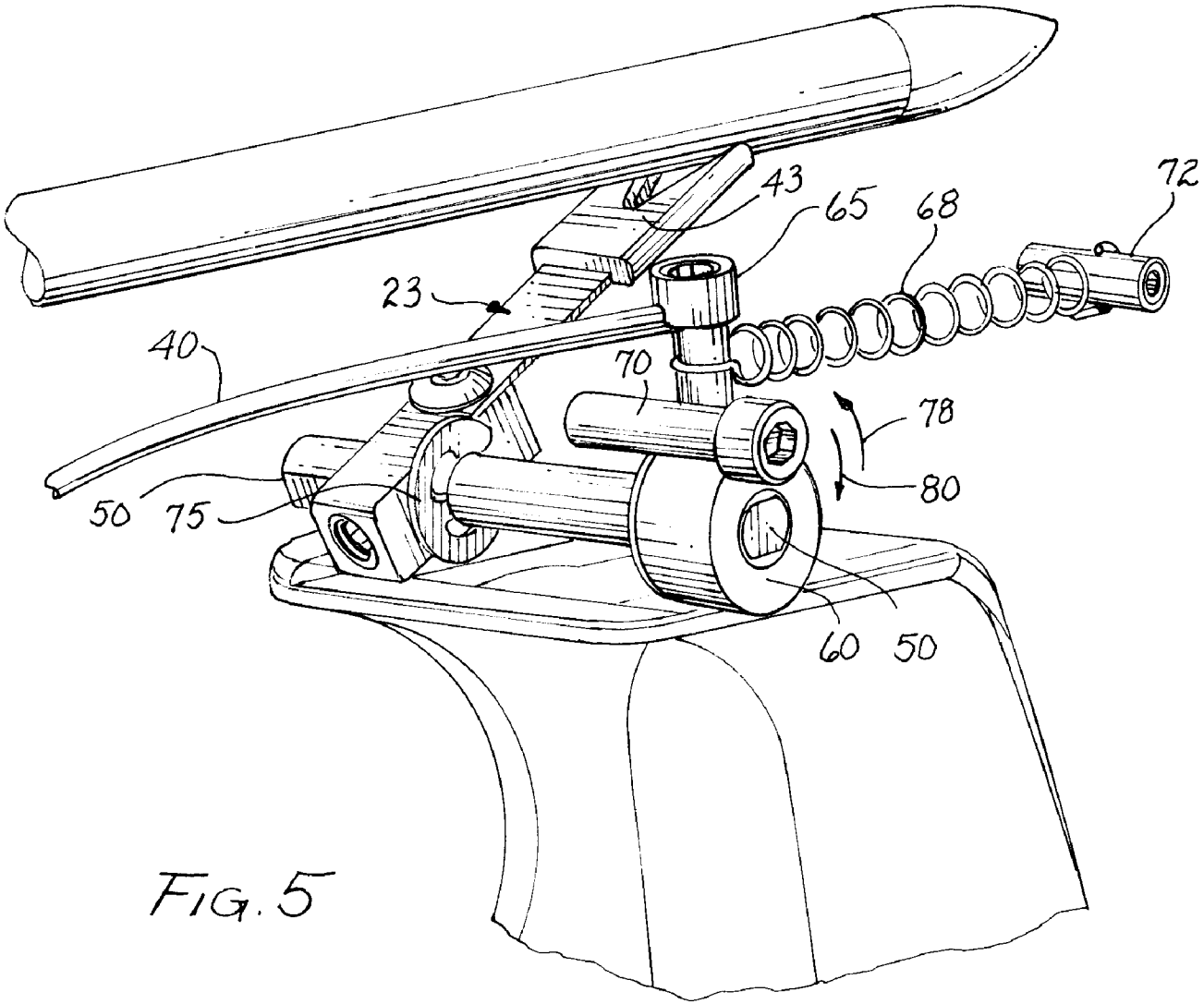
FIG. 5 is a pictorial representation of various parts of the system of the present invention useful for describing the operation thereof.

Referring to FIG. 5, the various operating parts of the present invention are shown without the supporting structure of the riser to facilitate the explanation of the operation thereof. Accordingly, the actuating shaft 50 is shown and is mounted in a corresponding cylindrical hole in the riser (not shown). A clip 75 engages a circumferential groove in the actuating shaft for securing the shaft in position (the clip 75 may also be seen in FIG. 2). The arrow rest tip 43 is shown in contact with and supporting the arrow 45 in a "ready" position. In this position, the coil spring 68, anchored to the anchor pin 72 is extended by the rotation of the actuating pin 65 about the axis of the actuating shaft 50 as shown by the arrow 78. The rotation in the direction thus indicated by the arrow 78 is limited by the contact of the actuating pin 65 with the stop pin 70. In this position, the coil spring is extended and the position of the actuating pin is fixed together with the resulting position of the arrow rest 23. When a triggering event occurs, such as by the release of tension of the trigger cord 40, the actuating pin 65 is permitted to yield to the force of the coil spring 68. The actuating pin is thus rotated about the longitudinal axis of the actuating shaft 50 in the direction indicated by the arrow 80. This rotation is imparted to the actuating shaft through the actuating collar and is therefore imparted to the arrow rest support block 42, arrow rest arm 41 and bifurcated arrow rest tip 43. The entire assembly swings downwardly in the direction of the arrow 80 until the motion is stopped by contact of the arrow rest with the resilient bumper 56 (FIG. 2) positioned in the bottom of the shelf recess 55. In this position, the arrow rest is below the shelf surface 54.

In the embodiment chosen for illustration, the triggering event that causes the rotation of the arrow rest from a supporting position to its rest position in the shelf recess provided therefor in the riser is the release of tension on the trigger cord 40. As indicated in FIG. 1, the trigger cord is attached to the cable slide 35. When the bowstring 38 is drawn as shown in FIG. 1, the cable slide 35 extends toward the end of the cable guide 30 and tensions the trigger cord 40 resulting in the rotation of the actuating pin 65 to which it is attached and the raising of the arrow rest 23 from its rest to its support position wherein it contacts said arrow shaft and supports the arrow in a ready position. When the bowstring is released and the arrow 24 is accelerated in the direction of a target, the cable slide moves toward the riser and in so doing releases the tension in the trigger cord permitting the actuating pin 65 to rotate about the actuating shaft in response to the tension of the tension spring 68. This action results in the rotation or dropping of the arrow rest 23 from its support position into the shelf recess 55 and in contact with the rubber bumper in the bottom of the shelf recess. This rotating action permits the arrow shaft to continue its accelerated travel over the riser shelf free of any further contact with the arrow rest.

What is claimed:

1. An archery compound bow comprising:

(a) a riser having first and second ends;

(b) a pair of limbs, each attached to and extending from a different one of said ends, respectively;

(c) a cam or wheel mounted for rotation at an end of each of said limbs, respectively;

(d) said riser including a shelf having a surface positioned intermediate said ends and having a shelf recess extending below said surface;

(e) an arrow rest supported by said riser and having an arrow supporting position and a retracted position; and (f) said arrow rest extending above said surface when in said arrow supporting position and positioned within said shelf recess and below said surface when in said retracted position.

2. The archery compound bow of claim 1 including biasing means to urge said arrow rest into said retracted position.

3. The archery compound bow of claim 2 wherein said biasing means is a spring.

4. The archery compound bow of claim 2 wherein said biasing means is an extension spring.

5. The archery compound bow of claim 2 wherein said biasing means is positioned within said riser.

6. An archery compound bow comprising:

(a) a riser having first and second ends;

(b) a pair of limbs, each attached to and extending from a different one of said ends, respectively;

(c) a cam or wheel mounted for rotation at an end of each of said limbs, respectively;

(d) said riser including a shelf having a surface positioned intermediate said ends and having a shelf recess extending below said surface, and having a biasing means recess within said riser;

(e) an arrow rest supported by said riser and having an arrow supporting position and a retracted position;

(f) said arrow rest extending above said surface when in said arrow supporting position and positioned within said shelf recess and below said surface when in said retracted position; and (g) biasing means positioned within said biasing means recess to urge said arrow rest into said retracted position.

7. The archery compound bow of claim 6 wherein said biasing means is a spring.

8. The archery compound bow of claim 6 wherein said biasing means is an extension spring.

9. In an archery compound bow including a riser having a shelf, the improvement comprising:

(a) means comprising a shelf recess formed in said shelf;

(b) an arrow rest supported by said riser and having an arrow supporting position and a retracted position; and (c) said arrow rest extending above said recess when in said arrow supporting position and extending into said recess when in said retracted position.

* * * * *